US006557865B1

(12) United States Patent
Reuss et al.

(10) Patent No.: US 6,557,865 B1
(45) Date of Patent: May 6, 2003

(54) HIGHBACK WITH ADJUSTABLE STIFFNESS

(75) Inventors: Stefan Reuss, Burlington, VT (US); Brian D. West, Burlington, VT (US); David J. Dodge, Williston, VT (US); Ryan Coulter, Stowe, VT (US); Christopher M. Doyle, Santa Fe, NM (US)

(73) Assignee: The Burton Corporation, Burlington, VT (US)

( * ) Notice: Subject to any disclaimer, the term of this patent is extended or adjusted under 35 U.S.C. 154(b) by 323 days.

(21) Appl. No.: 09/169,074

(22) Filed: Oct. 9, 1998

(51) Int. Cl.[7] ..... A63C 9/24

(52) U.S. Cl. ..... 280/14.21; 280/626; 280/633

(58) Field of Search ..... 280/14.2, 11.36, 280/611, 618, 617, 619, 631, 633, 634, 809, 842, 14.21; 36/117.8, 117.1, 117.2, 117.7, 117.9, 118.1, 118.3, 119.1

(56) References Cited

U.S. PATENT DOCUMENTS

| | | | | |
|---|---|---|---|---|
| 218,993 A | | 8/1879 | McCammon | |
| 3,419,974 A | | 1/1969 | Lange | |
| 3,593,435 A | | 7/1971 | Lange | |
| 3,645,017 A | | 2/1972 | Hickmann | |
| 3,807,060 A | * | 4/1974 | Hanson et al. | 36/119.1 |
| 3,945,135 A | * | 3/1976 | Hanson et al. | 36/2.5 AL |
| 4,078,322 A | | 3/1978 | Dalebout | |
| 4,281,468 A | | 8/1981 | Giese et al. | 36/121 |
| 4,367,885 A | | 1/1983 | Ramer | |
| 4,372,061 A | | 2/1983 | Pozzobon | |
| 4,565,017 A | * | 1/1986 | Ottieri | 36/117.8 |
| 4,669,202 A | | 6/1987 | Ottieri | |
| 4,759,137 A | | 7/1988 | Lederer | |
| 4,907,354 A | | 3/1990 | Benoit | |
| 5,216,826 A | | 6/1993 | Chaigne et al. | 36/117 |

(List continued on next page.)

FOREIGN PATENT DOCUMENTS

| | | |
|---|---|---|
| CH | 677 313 A5 | 5/1991 |
| DE | 41 25 224 A1 | 4/1992 |
| DE | 297 00 631 U1 | 7/1997 |
| DE | 297 00 632 U1 | 7/1997 |
| DE | 297 00 738 U1 | 7/1997 |
| DE | 196 02 667 C1 | 10/1997 |
| EP | 0 317 764 A2 | 5/1989 |
| EP | 0 724 851 A1 | 8/1996 |
| EP | 0 749 702 A1 | 12/1996 |
| EP | 0 838 242 A1 | 4/1998 |
| FR | 2 745 691 A1 | 9/1997 |
| JP | 7-503389 | 4/1995 |
| JP | 9-108398 | 4/1997 |
| WO | WO 97/35494 | 10/1997 |
| WO | WO 98/31247 | 7/1998 |

*Primary Examiner*—Brian L. Johnson
*Assistant Examiner*—Bridget Avery
(74) *Attorney, Agent, or Firm*—Wolf, Greenfield & Sacks, P.C.

(57) ABSTRACT

A highback for controlling a gliding board, such as a snowboard, through leg movement of a rider. The highback is provided with stiffness adjustability for accommodating the rider's particular riding preferences. Adjusting the highback stiffness allows the rider to selectively increase or decrease force transmission and board response based on individual riding preferences and/or riding conditions. Adjusting highback stiffness may also allow a rider to reduce pressure points between the highback and the leg, particularly the rider's calf muscle, for increased comfort while maintaining heelside support for board control. The highback includes a back member that may employ one or more sections that can be selectively adjusted to achieve a desired highback stiffness for board response and comfort. The degree of stiffness may be established by adjusting the flexibility of the highback at preselected locations of the back member. One or more interchangeable control elements may be mounted to the back member to adjust the highback stiffness.

56 Claims, 5 Drawing Sheets

U.S. PATENT DOCUMENTS 5,261,689 A * 11/1993 Carpenter et al. ..... 280/618
5,356,170 A 10/1994 Carpenter et al.
5,401,041 A * 3/1995 Jespersen ..... 280/14.2
5,498,033 A 3/1996 Hoshizaki et al.
5,556,123 A * 9/1996 Fournier ..... 280/607
5,606,808 A 3/1997 Gillard et al.
5,647,148 A * 7/1997 Meiselman ..... 36/115
5,701,689 A 12/1997 Hansen et al. ..... 36/115
5,713,587 A * 2/1998 Morrow et al. ..... 280/14.2
5,722,187 A 3/1998 Pamio et al.
5,727,797 A * 3/1998 Bowles ..... 280/14.2
5,732,483 A 3/1998 Cagliari
5,771,609 A 6/1998 Messmer ..... 36/89
5,784,810 A * 7/1998 Bonaventure ..... 36/118.2
5,791,678 A * 8/1998 Perlman ..... 280/618
5,815,953 A 10/1998 Kaufman et al. ..... 36/118.3
5,832,635 A 11/1998 Finney
5,901,469 A 5/1999 Saillet
5,975,557 A 11/1999 Snoke et al. ..... 280/624
5,979,082 A 11/1999 Pallatin ..... 36/118.2

* cited by examiner

HIGHBACK WITH ADJUSTABLE STIFFNESS

BACKGROUND OF THE INVENTION

1. Field of the Invention

The present invention relates generally to a highback for gliding sports and, more particularly, to a highback with adjustable stiffness.

2. Description of the Related Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive highback to which this patent is addressed is disclosed below particularly in connection with a soft snowboard boot and binding that is used in conjunction with a snowboard. It should be appreciated, however, that the present invention described below can be used in association with other types of gliding boards, as well as other types of boots, such as hybrid boots which combine various aspects of hard and soft boots.

Snowboard binding systems for soft snowboard boots typically include an upright member, called a "highback" (also known as a "lowback" and a "skyback"), that supports the rear lower portion of a rider's leg. The highback acts as a lever that helps transmit forces directly to and from the board, allowing the rider to efficiently control the board through leg movement. For example, flexing one's legs rearward against the highback places the board on its heel edge with a corresponding shift in weight and balance acting through the highback to complete a heelside turn.

Board control may be affected by the overall stiffness or flexibility of a highback. For example, as the stiffness of the highback increases, force transmission increases resulting in more responsive board control. Conversely, as the stiffness of the highback decreases, power transmission decreases resulting in less responsive board control.

Many riders, particularly experienced and aggressive riders, desire a stiff highback to ensure high power transmission and quick board response. In contrast, other riders, such as less aggressive or less experienced riders, may find a stiff highback overpowering. A stiff highback tends to transmit shock from the board to the rider, while a more flexible highback tends to absorb shock and chatter for a more forgiving ride.

The degree of highback stiffness may also affect a rider's comfort level when riding. In particular, a stiff highback may create undesirable pressure points against a rider's leg, rather than apply a uniform pressure distribution across the boot and leg. For example, the upper portion of a stiff highback may engage the rider's calf muscle, thereby concentrating much of the force between the highback and the rider's leg onto the calf muscle, a condition riders generally find uncomfortable.

While it is desirable for a highback to deliver optimal performance, Applicants recognize that variable factors, including rider ability, leg shape and rider sensitivity, tend to preclude a specific highback from providing optimal performance for every rider by failing to provide one or more particular characteristics desired by some riders. Consequently, a rider may employ a highback having some less preferable characteristics to gain other more desirable characteristics in its overall performance. For example, some riders may choose to use a responsive highback that may be less comfortable, while other riders may choose to use a less responsive highback that is more comfortable. Accordingly, riders may prefer a degree of adjustability in the highback stiffness for achieving a desirable balance between various highback characteristics, such as power transmission to the board and pressure distribution on the leg during heelside maneuvers.

It is an object of the present invention to provide an improved highback having stiffness adjustability for selective force transmission and riding comfort.

SUMMARY OF THE INVENTION

In one illustrative embodiment of the invention, a highback is provided for use with a component, such as a gliding board binding, a boot or a binding interface, that interfaces with a rider's leg and is supportable by a gliding board. The highback comprises a highback body that includes an upright back member to support a rear portion of a rider's leg. The highback body has a controlled stiffness that is adjustable between a first fixed stiffness and a second fixed stiffness that is different from the first fixed stiffness. The highback body is constructed and arranged for engagement with the component.

In another illustrative embodiment of the invention, a highback is provided for use with a snowboard component that interfaces with a rider's leg and is supportable by a snowboard. The highback comprises a highback body that includes a contoured upright back member to support a rear portion of a rider's leg. The back member has a controlled stiffness that is adjustable between a first fixed stiffness and a second fixed stiffness that is different from the first fixed stiffness. The back member includes a lower portion with a heel cup configured to hold a heel portion of a snowboard boot and at least one section supported on the lower portion for movement relative to the lower portion. Movement of the at least one section is controllable to adjust the stiffness of the back member. The at least one section is flexible relative to the lower portion along a flex zone defined in part by at least one aperture extending through the back member. The highback body is constructed and arranged to be supported on the snowboard component.

The highback may also include a control element that is mountable to the back member to limit the relative movement between the at least one section and the lower portion to fix the stiffness of the back member in one of the first fixed stiffness and the second fixed stiffness. The highback may further include a pair of lateral arms extending from opposing sides of the back member to pivotally mount the highback to the snowboard component.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

The present invention is directed to a highback that is provided with stiffness adjustability for accommodating a rider's particular riding preferences. Adjusting the highback stiffness allows the rider to selectively increase or decrease force transmission and board response based on individual riding preferences and/or riding conditions. Adjusting highback stiffness may also allow a rider to reduce pressure points between the highback and the leg, particularly the rider's calf muscle, for increased comfort while maintaining heelside support for board control. The highback may employ one or more sections that can be selectively arranged to achieve a desired highback stiffness for board response and comfort. One or more control elements may also be implemented to adjust the degree of the overall highback stiffness.

Figure 1:
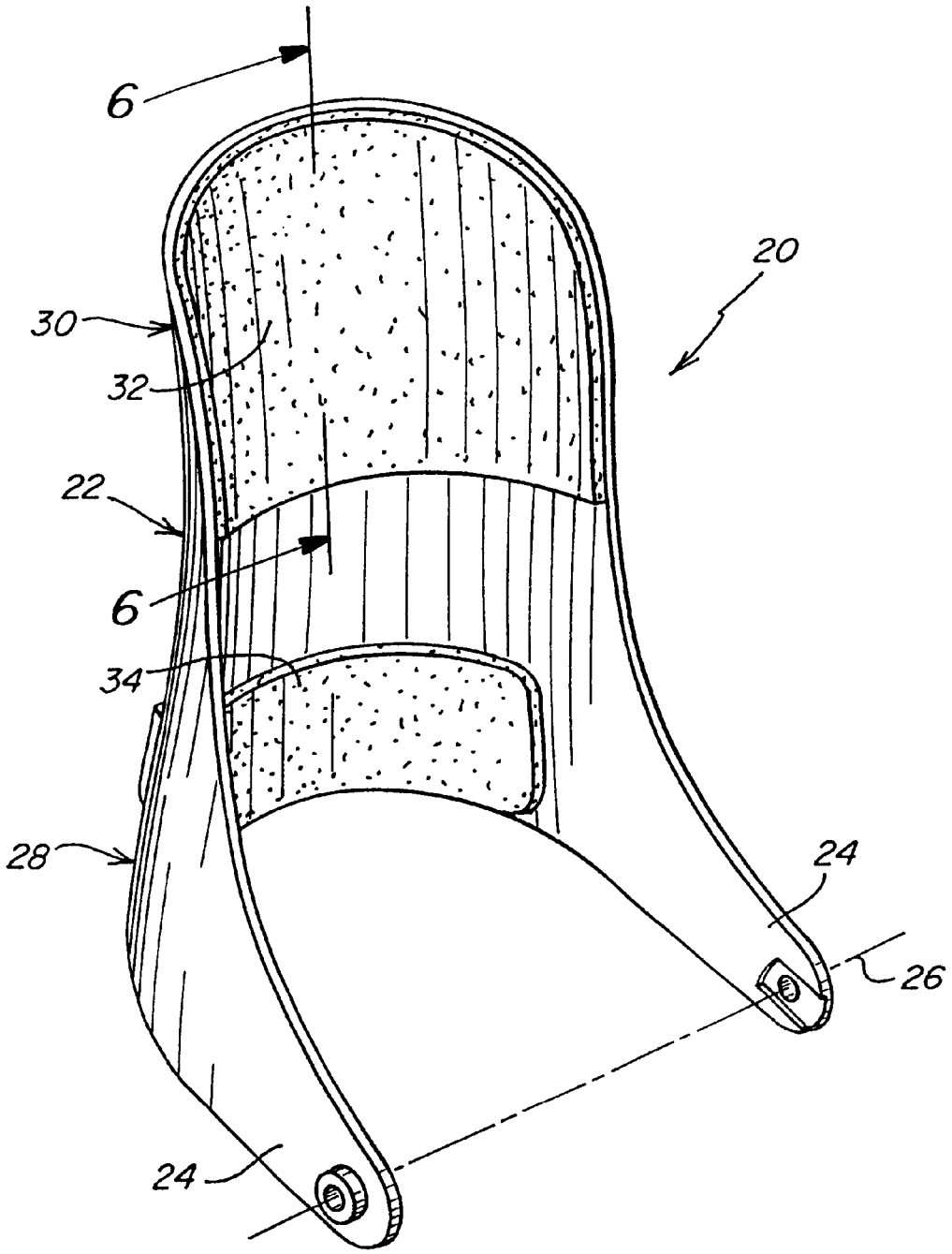
FIG. 1 is a perspective view of the highback with adjustable stiffness according to one illustrative embodiment of the invention.

In one illustrative embodiment as shown in FIG. 1, the highback 20 includes an upright back member 22 and a pair of lateral arms 24 that extend from opposing sides of the back member. The lateral arms 24 may be employed to pivotally attach the highback to a gliding board component, such as a snowboard binding, a snowboard boot or a binding interface, along a mounting axis 26 that is transverse to the length of the binding or boot.

The back member 22 preferably has a contoured configuration that is compatible with the shape of a boot. The highback 20 includes a heel cup 28 at the lower end of the back member that is configured to grip and hold the heel portion of the boot. The back member 22 transitions from the heel cup 28 to an upper portion 30 of the highback that is configured to extend along the rear portion of the rider's leg to provide heelside support for turning and controlling the board. The inner surface of the highback may include resilient pads 32, 34 to increase heel hold, to absorb shock and to facilitate pressure distribution across the boot and leg.

Figure 2:
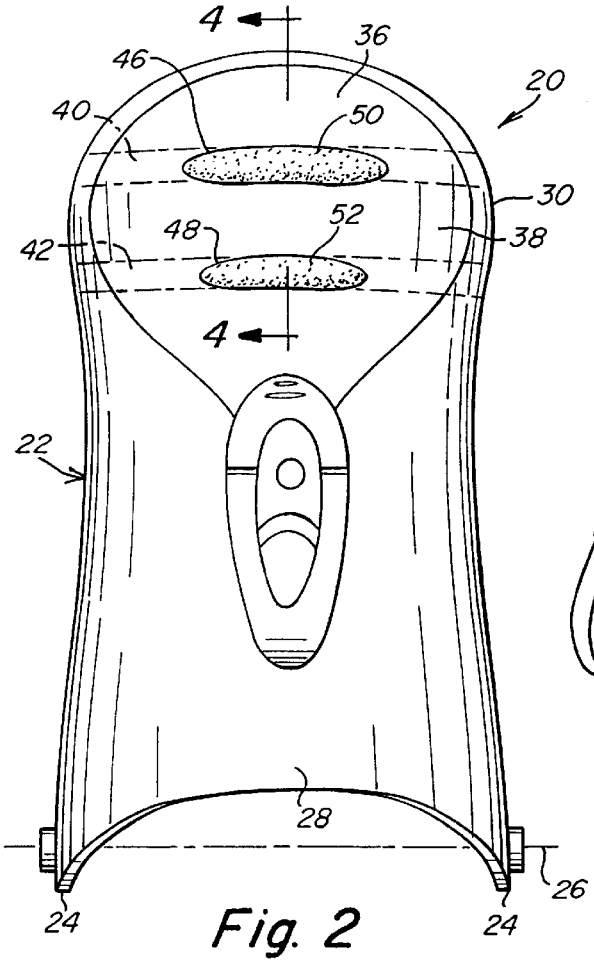
FIG. 2 is a rear view of the highback of FIG. 1.
Figure 3:
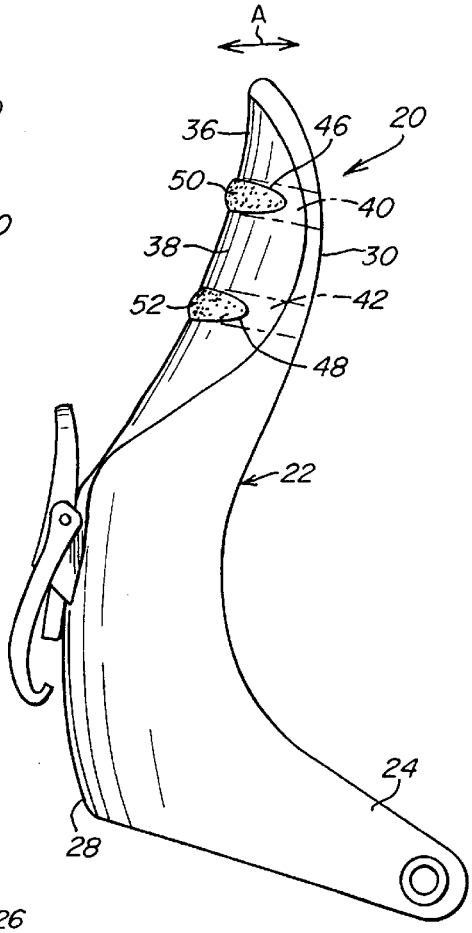
FIG. 3 is a side elevational view of the highback of FIGS. 1–2.

In one illustrative embodiment of the invention, the highback 20 includes one or more sections in its upper portion that may be configured to provide a desired highback stiffness. As illustrated in FIGS. 2–3, the upper portion 30 of the highback may include first and second sections 36, 38 that can be flexed relative to the heel cup 28. In the illustrative embodiment, the first section 36 can be flexed relative to the second section 38 which in turn can be flexed relative to the lower portion of the back member 22 above the heel cup 28. The degree and direction of flex may be defined by flex zones 40, 42 formed in the back member. As illustrated, the flex zones 40, 42 may extend generally parallel to the mounting axis 26 of the highback to allow the sections 36, 38 to flex in a toe-to-heel direction A. It is to be appreciated, however, that the highback may be configured to allow flexibility in any direction as would be appreciated by one of skill in the art. For example, one or more flex zones may be provided transverse to or in multiple directions relative to the mounting axis.

The overall stiffness of the highback 20 may be established by the number and size of the sections 36, 38. For example, the overall stiffness of the highback may be decreased by decreasing the height of each section and increasing the number of sections. It is to be appreciated, therefore, that the number and size of the sections are not limited to the illustrative embodiment shown in the figures.

The highback 20 may be configured with a particular degree of stiffness by adjusting the flexibility of the highback at selected locations on the back member. In the illustrative embodiment, first and second apertures 46, 48 extend across the upper portion 30 of the back member 22 to form the flex zones 40, 42. Although generally oval-shaped slots are shown, any suitably configured aperture may be employed to achieve the desired stiffness characteristics for the highback. It is to be appreciated, however, that the degree of highback stiffness may be established in any other suitable manner apparent to one of skill in the art. For example, rather than or in addition to apertures, the stiffness of the highback 20 may be increased or decreased by varying the thickness or surface texture of the back member 22 at selected locations. The stiffness may also be established using various structural members or reliefs, such as ribs or grooves. The highback stiffness may also be achieved using materials of varying characteristics at selected locations.

Since the degree of highback stiffness is a matter of individual rider preference, it is desirable that a rider be provided the option of selectively adjusting the stiffness of the highback. In one embodiment, highback stiffness may be adjusted using one or more control elements 50, 52 that are mountable to the highback. The control elements 50, 52 may be disposed in one or more of the apertures 46, 48 to control the relative flexibility of the first and second sections 36, 38 of the highback by acting as compressible wedges between the sections when the rider exerts heelside pressure on the highback.

Figure 4A:
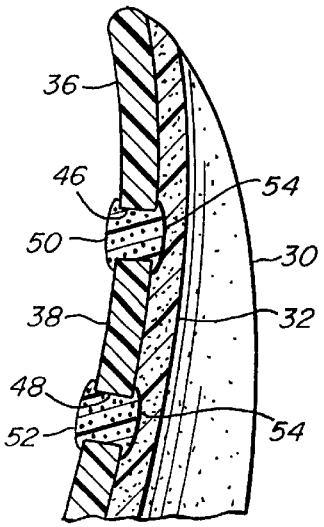
FIG. 4A is a cross-sectional view taken along section line 4—4 of FIG. 2 illustrating one embodiment of a stiffness control system.

The control elements 50, 52 are preferably removable so that a rider can readily adjust the overall highback stiffness by interchanging several control elements of varying stiffness. In one illustrative embodiment shown in FIG. 4A, the control elements 50, 52 are detachable plugs that may be locked into and removed from the apertures. Each plug may include an interlock 54, such as a barb, a tooth, an undercut or the like, that engages a corresponding feature, such as the periphery of the aperture, to retain the plug on the highback during anticipated riding conditions. The highback 20 may be provided with two or more plugs of different stiffness characteristics for each aperture to give a rider several options for highback stiffness.

A rider may adjust the highback stiffness by selectively interchanging one or more of the control elements 50, 52. At one extreme, the highback stiffness may be minimized by removing each of the control elements 50, 52 from the highback so that the sections 36, 38 may freely flex. At the opposite extreme, highback stiffness may be maximized by attaching rigid control elements 50, 52 to the highback, thereby substantially eliminating highback flexibility for high power transmission and quick board response. Intermediate levels of highback stiffness may be achieved by attaching one or more resilient control elements 50, 52 to the highback. Various combinations of control elements 50, 52 may also be employed to further adjust the highback stiffness in accordance with the rider's riding preferences as would be apparent to one of skill in the art.

Figure 4B:
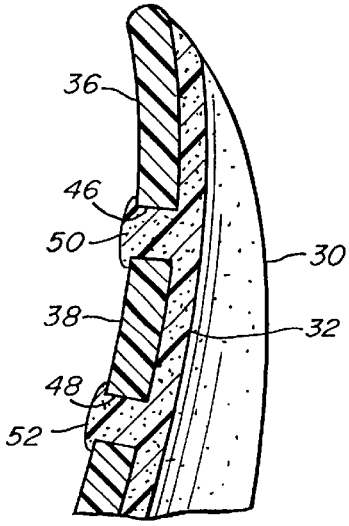
FIG. 4B is a cross-sectional view taken along section line 4—4 of FIG. 2 illustrating another embodiment of a stiffness control system.

In another embodiment shown in FIG. 4B, the control elements 50, 52 may be integrally formed on the rear surface of the upper pad 32 so that they protrude through the apertures 46, 48 when the pad is attached to the inner surface of the highback. The control elements 50, 52 may be formed of a material having different compressive properties than the pad. Several pads 32 having different stiffness characteristics may be provided to give the rider the option of adjusting the highback stiffness by selectively attaching one of pads to the highback.

Figure 5:
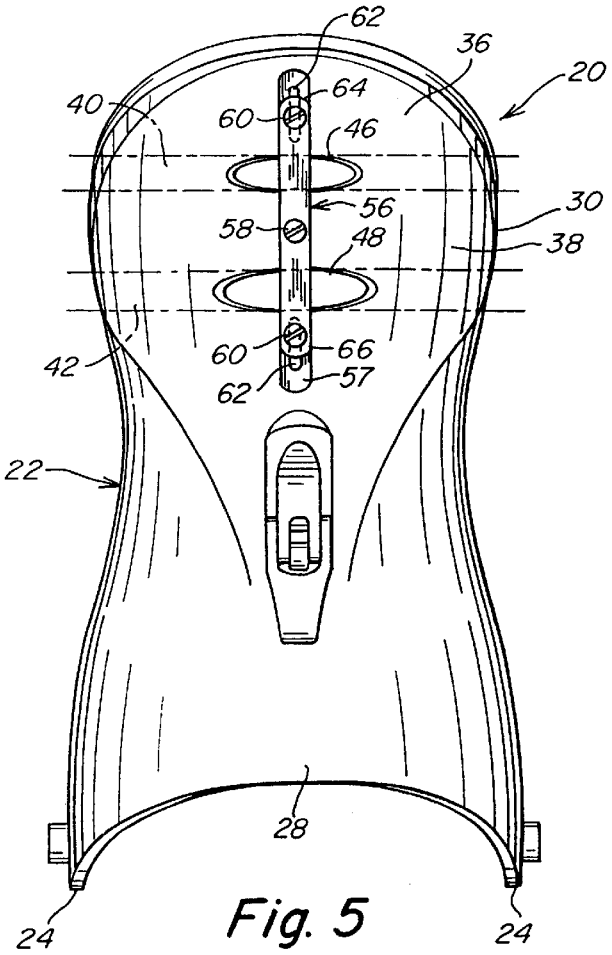
FIG. 5 is a rear view of the highback according to another embodiment of the invention illustrating an alternate stiffness control system.

In another illustrative embodiment of the invention, the control elements may include one or springs that are interchangeably attached to the highback. As shown in FIG. 5, a spring 56, such as a leaf spring, may be mounted within a groove 57 along the upper portion 30 of the back member 22. The intermediate portion of the spring 56 may be secured between the first and second sections 36, 38 using any suitable fastener 58, such as a screw or the like. The opposing ends of the spring 56 may be slidably secured to the highback using any suitable fastener 60, such as a screw, pin or the like, that extends through the spring 56 and corresponding slots 62 in the highback.

As illustrated, the first end 64 of the spring is slidably secured above the first aperture 46 and the second end 66 of the spring is slidably secured below the second aperture 48. The intermediate portion of the spring is fixed to the highback between the first and second apertures so that flexing the first and second sections 36, 38 of the highback causes the first and second ends 64, 66 of the spring to bend about its intermediate portion. The degree of highback stiffness may be controlled through the use of particular spring characteristics. For example, a spring with a high spring constant will provide greater highback stiffness than a spring with a low spring constant when subjected to the same applied force.

The highback 20 is preferably molded from a rigid plastic material, such as polycarbonate, polyolefin, polyurethane, polyethylene and the like, that is capable of providing efficient force transmission from the rider to the board. The control elements 50, 52 are preferably molded from a resilient material, such as an elastomer. It is to be appreciated, however, that the highback and control elements may be formed from any suitable material apparent to one of skill in the art. For example, the control elements may be made from various gels, plastics, foams and the like. In another embodiment, the control elements may include interchangeable compression springs or other suitable dampening means apparent to one of skill.

Figure 6:
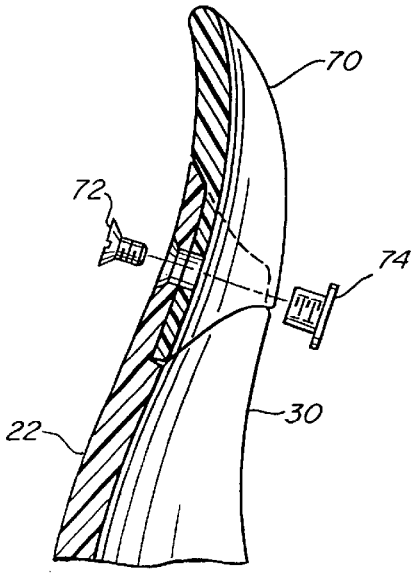
FIG. 6 is a cross-sectional view taken along section line 6—6 of FIG. 1 illustrating a further embodiment for adjusting highback stiffness.

In another illustrative embodiment of the invention, the stiffness of the highback 20 may be adjusted using a plurality of interchangeable highback uppers, each having a stiffness that differs from the other uppers. The uppers may also be provided with shapes having varying curvatures, heights and/or any other feature apparent to one of skill. As illustrated in FIG. 6, the back member 22 of the highback may detachably support any one of the interchangeable uppers 70 to provide a desired highback stiffness. The uppers 70 may be detachably connected to the highback using any suitable fastener apparent to one of skill, such as a screw 72 and nut 74 arrangement.

The adjustable highback according to the present invention may be employed in any gliding board activity, such as snowboarding, that would benefit from heelside support. For ease of understanding, however, and without limiting the scope of the invention, the inventive highback is now described below in connection with a snowboard binding.

Figure 7:
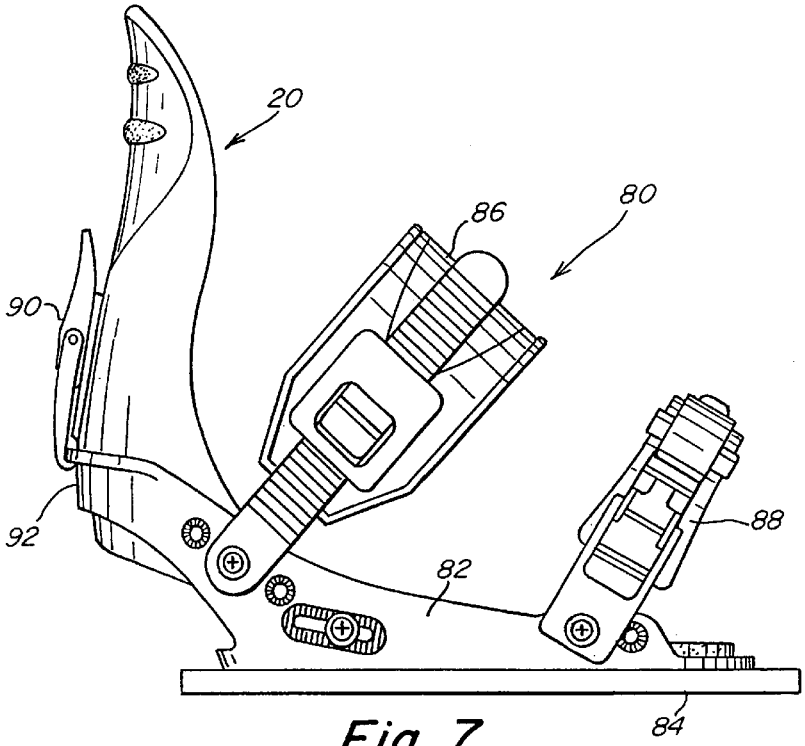
FIG. 7 is a side view of the highback incorporated with an illustrative embodiment of a snowboard binding according to another aspect of the invention.

In an illustrative embodiment shown in FIG. 7, the snowboard binding 80 may include a baseplate 82, which is mountable to a snowboard 84, and one or more binding straps, preferably adjustable straps, that are attached to the baseplate for securing a boot (not shown) to the snowboard. The highback 20 is pivotally mounted to the sidewalls of the baseplate 82. As illustrated, the binding 80 may include an ankle strap 86 that extends across the ankle portion of the boot to hold down the rider's heel and a toe strap 88 that extends across and holds down the front portion of the boot. It is to be understood, however, that the binding 80 may implement other strap configurations. A lockdown forward lean adjuster 90 may also be provided to interact with a heel hoop 92 for setting the highback 20 at a preselected forward lean angle relative to the board and to lock down the highback for enhanced toeside response.

The highback 20 of the present invention, however, is not limited to any particular type of binding. For example, the highback may also be implemented with a step-in snowboard binding that includes a locking mechanism that engages corresponding features provided, either directly or indirectly, on a snowboard boot. The highback may be mounted to a binding baseplate in a manner similar to the binding described above. Examples of step-in snowboard bindings that may incorporate the flexible highback are described in U.S. Pat. No. 5,722,680 and U.S. patent application Ser. No. 08/780,721, now U.S. Pat. No. 6,123,354 which are incorporated herein by reference.

Figure 8:
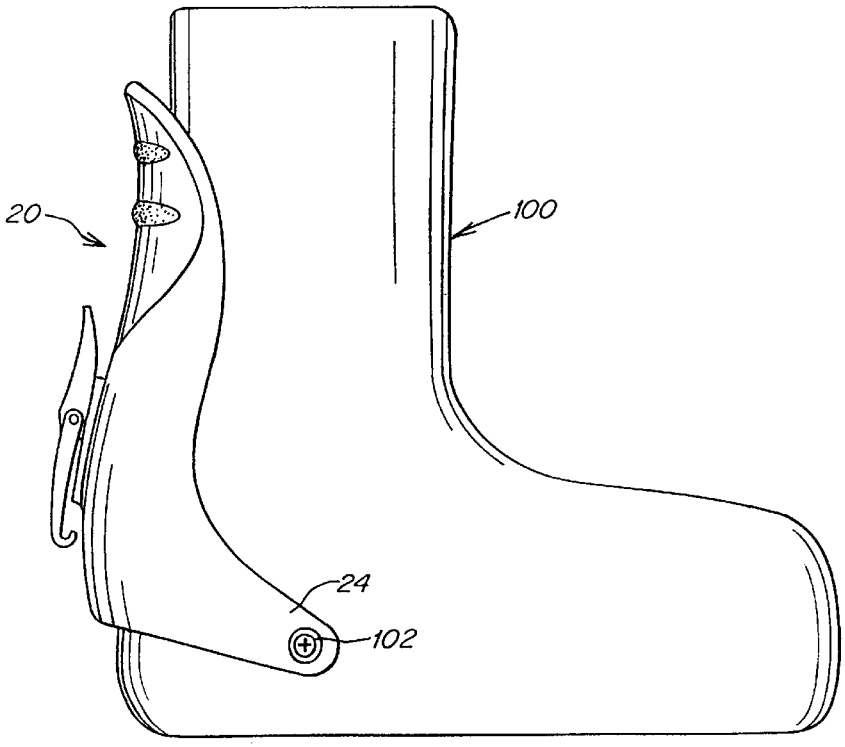
FIG. 8 is a side view of the highback incorporated with an illustrative embodiment of a snowboard boot system according to a further aspect of the invention.

In another embodiment, the highback 20 of the present invention may be either permanently attached to or removable from a snowboard boot. A removable highback provides system flexibility by allowing the boot to be implemented with binding systems that already include a highback mounted to a binding baseplate. As illustrated in FIG. 8, the highback 20 is movably mounted to the heel region of a boot 100. The lateral arms 24 are preferably attached below the ankle portion of the boot for facilitating lateral or side-to-side boot flexibility that allows desirable lateral foot roll. The lateral arms 24 may be attached to the boot, preferably at reinforced attachment points, using any suitable fastener 102, such as a screw, rivet or the like, that passes through each lateral arm.

In another aspect of the invention, the flexible highback 20 may be implemented with a detachable binding interface system for interfacing a boot to a binding. As illustrated in one embodiment shown in FIG. 9, the interface 110 includes a body 112 and at least one adjustable strap 114 that is arranged to be disposed across the ankle portion of the boot 116, which is shown in phantom. The highback 20 is movably mounted to the sidewalls of the interface body 112 using a suitable fastener 115 that passes through the lateral arms 24 of the highback. The body 112 of the interface may include one or more mating features 118, as would be apparent to one of skill in the art, that are adapted to engage corresponding engagement members 120 on the binding 122.

Figure 9:
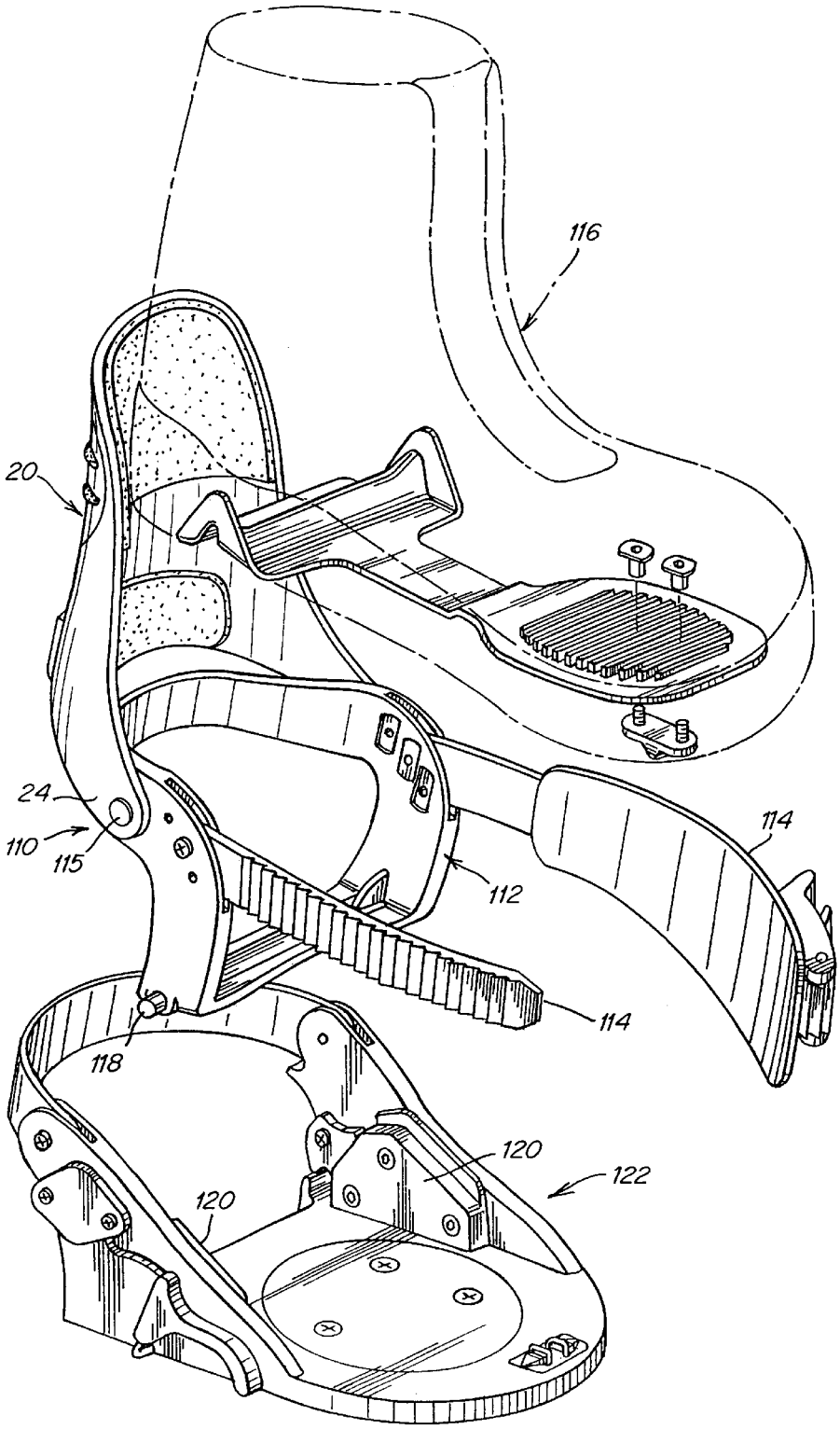
FIG. 9 is a perspective view of the highback incorporated with an illustrative embodiment of a detachable binding interface according to another aspect of the invention.

The particular binding interface 110 and binding 122 shown in FIG. 9 is described in greater detail in a U.S. application Ser. No. 09/062,131, U.S. Pat. No. 6,347,805 which is incorporated herein by reference.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A highback, for use with a snowboard component that interfaces with a rider's leg and is supportable by a snowboard, the highback comprising:

a highback body including an upright back member constructed and arranged to support a rear portion of a rider's leg, the highback body having a controlled stiffness that is adjustable between a first fixed stiffness and a second fixed stiffness that is different from the first fixed stiffness, the highback body constructed and arranged to be mounted to the snowboard component; and a forward lean adjuster mounted to the highback body, the forward lean adjuster constructed and arranged to engage a portion of a snowboard binding to set the highback at a preselected forward lean position relative to the snowboard.

2. The highback recited in claim 1, wherein the back member includes a lower portion and at least one section movably supported on the lower portion, movement of the at least one section relative to the lower portion being controllable to adjust the stiffness of the highback body.

3. The highback recited in claim 2, wherein the lower portion includes a heel cup, the at least one section being flexibly supported on the lower portion of the back member above the heel cup.

4. The highback recited in claim 3, wherein the highback body further includes a pair of lateral arms extending from opposing sides of the back member, the lateral arms being constructed and arranged to pivotally mount the highback to the component along a mounting axis, the at least one section being flexibly supported along a flex zone that is generally parallel to the mounting axis.

5. The highback recited in claim 3, wherein the at least one section is flexible in a toe-to-heel direction.

6. The highback recited in claim 3, wherein the at least one section is flexible relative to the lower portion of the back member along a flex zone formed in part by at least one aperture extending through the back member.

7. The highback recited in claim 6, wherein the at least one aperture has a generally oval shape extending across the back member.

8. The highback recited in claim 2, further comprising at least one control element that is mountable to the highback body to limit the relative movement between the at least one section and the lower portion to fix the stiffness of the highback body in one of the first fixed stiffness and the second fixed stiffness.

9. The highback recited in claim 8, wherein the stiffness of the highback body is fixed at the first fixed stiffness when the at least one control element is mounted to the back member and at the second fixed stiffness when the at least one control element is detached from the back member.

10. The highback recited in claim 8, wherein the at least one control element includes a first control element having a first stiffness and a second control element having a second stiffness that is different from the first stiffness, the first control element being mounted to the back member to set the stiffness of the back member at the first fixed stiffness, the second control element being mounted to the back member to set the stiffness of the back member at the second fixed stiffness.

11. The highback recited in claim 8, wherein the at least one control element includes a plug that is insertable into an aperture extending through the back member.

12. The highback recited in claim 11, wherein the plug is compressible between the at least one section and the lower portion to limit relative movement therebetween to adjust the stiffness of the highback body.

13. The highback recited in claim 11, wherein the plug is rigid to substantially eliminate relative movement between the at least one section and the lower portion to increase the stiffness of the highback body.

14. The highback recited in claim 8, wherein the at least one control element includes at least one spring attached to the back member, the spring having a predetermined spring constant to adjust the stiffness of the highback body to one of the first fixed stiffness and the second fixed stiffness.

15. The highback recited in claim 14, wherein the spring is a leaf spring, at least one end of the spring being slidably connected to the back member.

16. The highback recited in claim 2, wherein the at least one section includes a first section having a first stiffness and a second section having a second stiffness that is different from the first stiffness, the first and second sections being interchangeably supported on the back member to adjust the stiffness between the first fixed stiffness and the second fixed stiffness.

17. The highback recited in claim 1, in combination with the snowboard component, the highback being mounted on the snowboard component.

18. The highback recited in claim 17, wherein the snowboard component includes a snowboard binding having a baseplate, the highback being pivotally mounted to the baseplate.

19. The highback recited in claim 18, wherein the snowboard binding includes at least one adjustable strap mounted to the baseplate to secure a snowboard boot.

20. The highback recited in claim 18, wherein the snowboard binding is a step-in binding.

21. The highback recited in claim 17, wherein the snowboard component includes a snowboard boot, the highback being pivotally mounted to the snowboard boot.

22. The highback recited in claim 17, wherein the snowboard component includes a detachable binding interface that is constructed and arranged to interface a snowboard boot with a snowboard binding.

23. The highback recited in claim 1, wherein the back member has a contoured configuration that is compatible with the rear portion of the rider's leg.

24. The highback recited in claim 23, wherein the highback body further includes a pair of lateral arms extending from opposing sides of the back member for mounting the highback to the component.

25. The highback recited in claim 24, wherein the back member has an inner surface extending between the opposing sides with a generally concave shape.

26. A highback for use with a snowboard component that interfaces with a rider's leg and is supportable by a snowboard, the highback comprising:

a highback body constructed and arranged to be supported on the snowboard component, the highback body including, a contoured upright back member constructed and arranged to support a rear portion of a rider's leg, the back member having a controlled stiffness that is adjustable between a first fixed stiffness and a second fixed stiffness that is different from the first fixed stiffness, the back member including a lower portion with a heel cup configured to hold a heel portion of a snowboard boot and at least one section supported on the lower portion for movement relative to the lower portion, the movement of the at least one section relative to the lower portion being controllable to adjust the stiffness of the back member, the at least one section being flexible relative to the lower portion along a flex zone defined in part by at least one aperture extending through the back member;

a control element that is mountable to the back member to limit the relative movement between the at least one section and the lower portion to fix the stiffness of the back member in one of the first fixed stiffness and the second fixed stiffness; and a pair of lateral arms extending from opposing sides of the lower portion of the back member that are constructed and arranged to pivotally mount the lower portion of the highback to the snowboard component.

27. The highback recited in claim 26, in combination with the snowboard component, the highback being mounted on the snowboard component.

28. The highback recited in claim 27, wherein the snowboard component includes a snowboard binding having a baseplate, the highback being pivotally mounted to the baseplate.

29. The highback recited in claim 28, wherein the snowboard binding includes at least one adjustable strap mounted to the baseplate to secure a snowboard boot.

30. The highback recited in claim 28, wherein the snowboard binding is a step-in binding.

31. The highback recited in claim 27, wherein the snowboard component includes a snowboard boot, the highback being pivotally mounted to the snowboard boot.

32. The highback recited in claim 27, wherein the snowboard component includes a detachable binding interface that is constructed and arranged to interface a snowboard boot with a snowboard binding.

33. A highback for use with a snowboard component that interfaces with a rider's leg and is supportable by a snowboard, the highback comprising:

a highback body having an adjustable stiffness, the highback body being constructed and arranged to be supported on the snowboard component to support the rear portion of a rider's leg;

means for adjusting the stiffness of the highback body between a first fixed stiffness and a second fixed stiffness that is different from the first fixed stiffness; and a forward lean adjuster mounted to the highback body, the forward lean adjuster constructed and arranged to engage a portion of the binding to set the highback at a preselected forward lean position relative to the snowboard.

34. The highback recited in claim 33, wherein the means for adjusting includes means for controlling the flexibility of the highback body.

35. The highback recited in claim 1, wherein the forward lean adjuster includes a lockdown feature that is constructed and arranged to lock down the highback to the snowboard binding.

36. An apparatus comprising:

a snowboard binding to secure a snowboard boot to a snowboard, the snowboard binding including, a baseplate that is constructed and arranged to be mounted to the snowboard; and a highback pivotally mounted to the baseplate, the highback including a highback body with an upright back member that is constructed and arranged to support a rear portion of a rider's leg, the highback body having a controlled stiffness that is adjustable between a first fixed stiffness and a second fixed stiffness that is different from the first fixed stiffness.

37. The highback recited in claim 36, wherein the back member includes a lower portion and at least one section movably supported on the lower portion, movement of the at least one section relative to the lower portion being controllable to adjust the stiffness of the highback body.

38. The highback recited in claim 38, wherein the lower portion includes a heel cup, the at least one section being flexibly supported on the lower portion of the back member above the heel cup.

39. The highback recited in claim 38, wherein the highback body further includes a pair of lateral arms extending from opposing sides of the back member, the lateral arms being constructed and arranged to pivotally mount the highback to the component along a mounting axis, the at least one section being flexibly supported along a flex zone that is generally parallel to the mounting axis.

40. The highback recited in claim 38, wherein the at least one section is flexible in a toe-to-heel direction.

41. The highback recited in claim 38, wherein the at least one section is flexible relative to the lower portion of the back member along a flex zone formed in part by at least one aperture extending through the back member.

42. The highback recited in claim 42, wherein the at least one aperture has a generally oval shape extending across the back member.

43. The highback recited in claim 37, further comprising at least one control element that is mountable to the highback body to limit the relative movement between the at least one section and the lower portion to fix the stiffness of the highback body in one of the first fixed stiffness and the second fixed stiffness.

44. The highback recited in claim 43, wherein the stiffness of the highback body is fixed at the first fixed stiffness when the at least one control element is mounted to the back member and at the second fixed stiffness when the at least one control element is detached from the back member.

45. The highback recited in claim 43, wherein the at least one control element includes a first control element having a first stiffness and a second control element having a second stiffness that is different from the first stiffness, the first control element being mounted to the back member to set the stiffness of the back member at the first fixed stiffness, the second control element being mounted to the back member to set the stiffness of the back member at the second fixed stiffness.

46. The highback recited in claim 43, wherein the at least one control element includes a plug that is insertable into an aperture extending through the back member.

47. The highback recited in claim 46, wherein the plug is compressible between the at least one section and the lower portion to limit relative movement therebetween to adjust the stiffness of the highback body.

48. The highback recited in claim 46, wherein the plug is rigid to substantially eliminate relative movement between the at least one section and the lower portion to increase the stiffness of the highback body.

49. The highback recited in claim 43, wherein the at least one control element includes at least one spring attached to the back member, the spring having a predetermined spring constant to adjust the stiffness of the highback body to one of the first fixed stiffness and the second fixed stiffness.

50. The highback recited in claim 49, wherein the spring is a leaf spring, at least one end of the spring being slidably connected to the back member.

51. The highback recited in claim 36, wherein the at least one section includes a first section having a first stiffness and a second section having a second stiffness that is different from the first stiffness, the first and second sections being interchangeably supported on the back member to adjust the stiffness between the first fixed stiffness and the second fixed stiffness.

52. The highback recited in claim 36, wherein the snowboard binding includes at least one adjustable strap mounted to the baseplate to secure a snowboard boot.

53. The highback recited in claim 36, wherein the snowboard binding is a step-in binding.

54. The highback recited in claim 36, wherein the back member has a contoured configuration that is compatible with the rear portion of the rider's leg.

55. The highback recited in claim 54, wherein the highback body further includes a pair of lateral arms extending from opposing sides of the back member that are pivotally mounted to the baseplate.

56. The highback recited in claim 55, wherein the back member has an inner surface extending between the opposing sides with a generally concave shape.

* * * * *

UNITED STATES PATENT AND TRADEMARK OFFICE

CERTIFICATE OF CORRECTION

PATENT NO. : 6,557,865 B1
DATED : May 6, 2003
INVENTOR(S) : Reuss et al.

It is certified that error appears in the above-identified patent and that said Letters Patent is hereby corrected as shown below:

Column 10,
Line 15, replace “38” with -- 37 --.
Line 32, replace “42” with -- 41 --.

Signed and Sealed this

Twenty-sixth Day of August, 2003

JAMES E. ROGAN
*Director of the United States Patent and Trademark Office*